US011541917B2

(12) United States Patent
Wike et al.

(10) Patent No.: US 11,541,917 B2
(45) Date of Patent: Jan. 3, 2023

(54) RAILWAY TRUCK ASSEMBLY HAVING FORCE-DETECTING LOAD CELLS

(71) Applicant: Amsted Rail Company, Inc., Chicago, IL (US)

(72) Inventors: Paul Steven Wike, St. Louis, MO (US); Thomas Petrunich, Troy, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 200 days.

(21) Appl. No.: 16/331,192

(22) PCT Filed: Mar. 5, 2019

(86) PCT No.: PCT/US2019/020733
§ 371 (c)(1),
(2) Date: Mar. 7, 2019

(87) PCT Pub. No.: WO2019/173328
PCT Pub. Date: Sep. 12, 2019

(65) Prior Publication Data

US 2021/0362755 A1 Nov. 25, 2021

Related U.S. Application Data

(60) Provisional application No. 62/639,780, filed on Mar. 7, 2018.

(51) Int. Cl.
*B61F 5/52* (2006.01)

(52) U.S. Cl.
CPC ..... *B61F 5/52* (2013.01)

(58) Field of Classification Search
CPC ..... B61F 5/52; B61F 5/00; B61L 15/0081; G01L 5/0085; G01L 5/107
See application file for complete search history.

(56) References Cited

U.S. PATENT DOCUMENTS 5,524,551 A * 6/1996 Hawthorne ..... F16F 3/04 105/198.4
6,441,324 B1 8/2002 Stimpson
(Continued)

FOREIGN PATENT DOCUMENTS

| | | |
|---|---|---|
| DE | 10 2010 056434 | 2/2012 |
| JP | 2002 079941 | 3/2002 |
| JP | 2004 209995 | 7/2004 |

OTHER PUBLICATIONS

Notification of Transmittal of the International Search Report and The Written Opinion of the International Searching Authority, or The Declaration for PCT/US2019/020733, dated Jun. 5, 2019.

*Primary Examiner* — Mark T Le
(74) *Attorney, Agent, or Firm* — The Small Patent Law Group LLC; Joseph M. Butscher

(57) ABSTRACT

A force analysis system and method include a truck assembly that is configured to travel along a track having rails. The truck assembly includes a first side frame, a second side frame, a bolster extending between the first side frame and the second side frame, a first wheel set coupled to the first side frame and the second side frame, a second wheel set coupled to the first side frame and the second side frame, and one or more load cells disposed within the first side frame and/or the second side frame. The load cell(s) are configured to detect forces exerted in relation to the first side frame, the second side frame, and/or the bolster.

21 Claims, 5 Drawing Sheets

(56) References Cited

U.S. PATENT DOCUMENTS

| | | | | |
|---|---|---|---|---|
| 6,495,774 | B1 * | 12/2002 | Pederson | G01G 19/08 177/136 |
| 7,214,893 | B2 * | 5/2007 | Sikula | G01G 21/23 177/DIG. 9 |
| 2007/0152107 | A1 * | 7/2007 | LeFebvre | B61K 9/00 246/169 R |
| 2010/0200307 | A1 * | 8/2010 | Toms | G01C 9/00 177/163 |
| 2013/0239700 | A1 * | 9/2013 | Benfield | G01L 1/18 73/862.044 |
| 2015/0027820 | A1 * | 1/2015 | Park | F16D 65/18 188/72.1 |
| 2016/0320229 | A1 | 11/2016 | Nihimura | |

* cited by examiner

RAILWAY TRUCK ASSEMBLY HAVING FORCE-DETECTING LOAD CELLS

RELATED APPLICATIONS

This application is a National Phase of International Application No. PCT/US19/20733, filed Mar. 5, 2019, which relates to and claims priority benefits from U.S. Provisional Patent Application No. 62/639,780, filed Mar. 7, 2018, each of which is hereby incorporated by reference in its entirety.

FIELD OF THE DISCLOSURE

Embodiments of the present disclosure generally relate to truck assemblies for rail vehicles, such as rail cars, and, more particularly, to truck assemblies that include one or more force-detecting load cells.

BACKGROUND OF THE DISCLOSURE

Rail vehicles travel along railways, which have tracks that include rails. A rail vehicle such as a rail car includes truck assemblies. Each truck assembly includes two side frames and a bolster. Friction shoes are disposed between the bolster and the side frames. The friction shoes are configured to provide damping for suspension.

Friction shoe damping has been used for decades, and has remained relatively unchanged into the present day. However, as rail vehicles continue to carry increased capacity, certain friction shoes may not provide effective damping.

Variant conditions that interrupt fundamental friction have always been present, but were typically not prominent when the carrying capacity of rail cars was lower and performance requirements were not as stringent. Such variant conditions may influence truck assemblies that travel over undulating track at certain speeds. In order to design truck assemblies that are able to support increasing capacity, an understanding of the nature of the forces exerted into the truck assemblies is needed.

SUMMARY OF THE DISCLOSURE

A need exists for a system and a method for analyzing forces exerted into a truck assembly. Further, a need exists for a system and a method for monitoring forces exerted into a truck assembly during operation thereof. Moreover, a need exists for a system and a method for gathering force data exerted into a truck assembly in order to determine a structural integrity of the truck assembly, as well as design considerations for future truck assemblies.

With those needs in mind, certain embodiments of the present disclosure provide a truck assembly that is configured to travel along a track having rails. The truck assembly includes a first side frame, a second side frame, a bolster extending between the first side frame and the second side frame, a first wheel set coupled to the first side frame and the second side frame, a second wheel set coupled to the first side frame and the second side frame, and one or more load cells (such as 3 axis load cells) disposed within one or both of the first side frame or the second side frame. The load cell(s) are configured to detect forces exerted in relation to one or more of the first side frame, the second side frame, or the bolster.

In at least one embodiment, the truck assembly also includes one or more friction shoes. The load cell(s) are configured to detect the forces exerted in relation to the friction shoe(s). In at least one embodiment, the load cell(s) connect to the friction shoe(s). The load cell(s) detect frictional forces exerted in relation to the friction shoe(s), and output force signals including force data indicative of the frictional forces exerted in relation to the friction shoe(s).

In at least one embodiment, the truck assembly includes a first damper system coupled to the first side frame, and a second damper system coupled to the second side frame. Each of the first damper system and the second damper system may include load coils that support the bolster, and control coils that support friction shoes. In at least one embodiment, the load cell(s) are operatively coupled to one or both of the first damper system or the second damper system.

In at least one embodiment, the load cell(s) are integrally formed with one or both of the first side frame or the second side frame. For example, the load cell(s) are disposed within one or both of the first side frame or the second side frame.

In at least one embodiment, the load cell(s) are configured to output force signals including force data indicative of the forces. The force signals may be received by a force analysis control unit.

In at least one embodiment, the load cell(s) are disposed within one or more columns of one or both of the first side frame or the second side frame. The column(s) may include one or more recess pockets. The load cell(s) may be disposed within the recess pocket(s).

In at least one embodiment, the load cell(s) are disposed between outer end walls of columns of one or both of the first side frame or the second side frame and one or more friction shoes coupled to one or both of the first side frame or the second side frame. One or more bolt plates may be coupled to the load cell(s). One or more column wear plate(s) may be coupled to the bolt plate(s).

In at least one embodiment, the load cell(s) are sandwiched between an outer end wall of a column and a friction shoe. A bolt plate is coupled to an interior surface of the load cell(s). A column wear plate is coupled to an interior surface of the bolt plate. An interior surface of the column wear plate abuts against the friction shoe.

In at least one embodiment, forces between the friction shoe and the column wear plate create resistance to movement. Portions of the friction shoe and the column wear plate also contribute to the resistance to movement. Frictional forces related to the resistance to movement are detected by the one or more load cells.

Certain embodiments of the present disclosure provide a force analysis system that includes a truck assembly that is configured to travel along a track having rails, as described herein, a force analysis control unit in communication with the load cell(s), wherein the force analysis control unit is configured to receive the force signals, and a user interface in communication with the force analysis control unit. The force analysis control unit is configured to output the force data to the user interface.

Certain embodiments of the present disclosure provide a force analysis method for a truck assembly that is configured to travel along the track having rails. The force analysis method includes providing the first side frame and the second side frame, extending a bolster between the first side frame and the second side frame, coupling the first wheel set and the second wheel set to the first side frame and the second side frame, disposing one or more load cells within one or both of the first side frame or the second side frame, and detecting, by the one or more load cells, forces exerted in relation to one or more of the first side frame, the second side frame, or the bolster.

Certain embodiments of the present disclosure provide a side frame for a truck assembly that is configured to travel along a track having rails. The side frame includes a frame body, and one or more load cells disposed within the frame body. The load cells(s) are configured to detect forces exerted in relation to the side frame.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide a truck assembly including one or more load cells integrally formed with one or more side frames. In order to understand the influence of variant conditions in relation to friction damping and to design damping systems that reduce the effects of variant conditions, the load cells are configured to detect forces exerted in relation to the side frames. In at least one embodiment, the load cells detect forces exerted in relation (such as by, into, or onto) friction shoes. The load cells are configured to collect force data, which may be analyzed to develop friction damping that conforms to performance requirements, as well as revenue service to collect data and develop friction damping systems for long-term endurance. The ability to identify the variant conditions of friction damping eliminates, minimizes, or otherwise reduces assumptions, and provides insight for rapid development of damping systems. Further, the ability to establish detailed damping performance leads to several benefits, such as additional wheel life, improved stability, and reduced maintenance.

Figure 1:
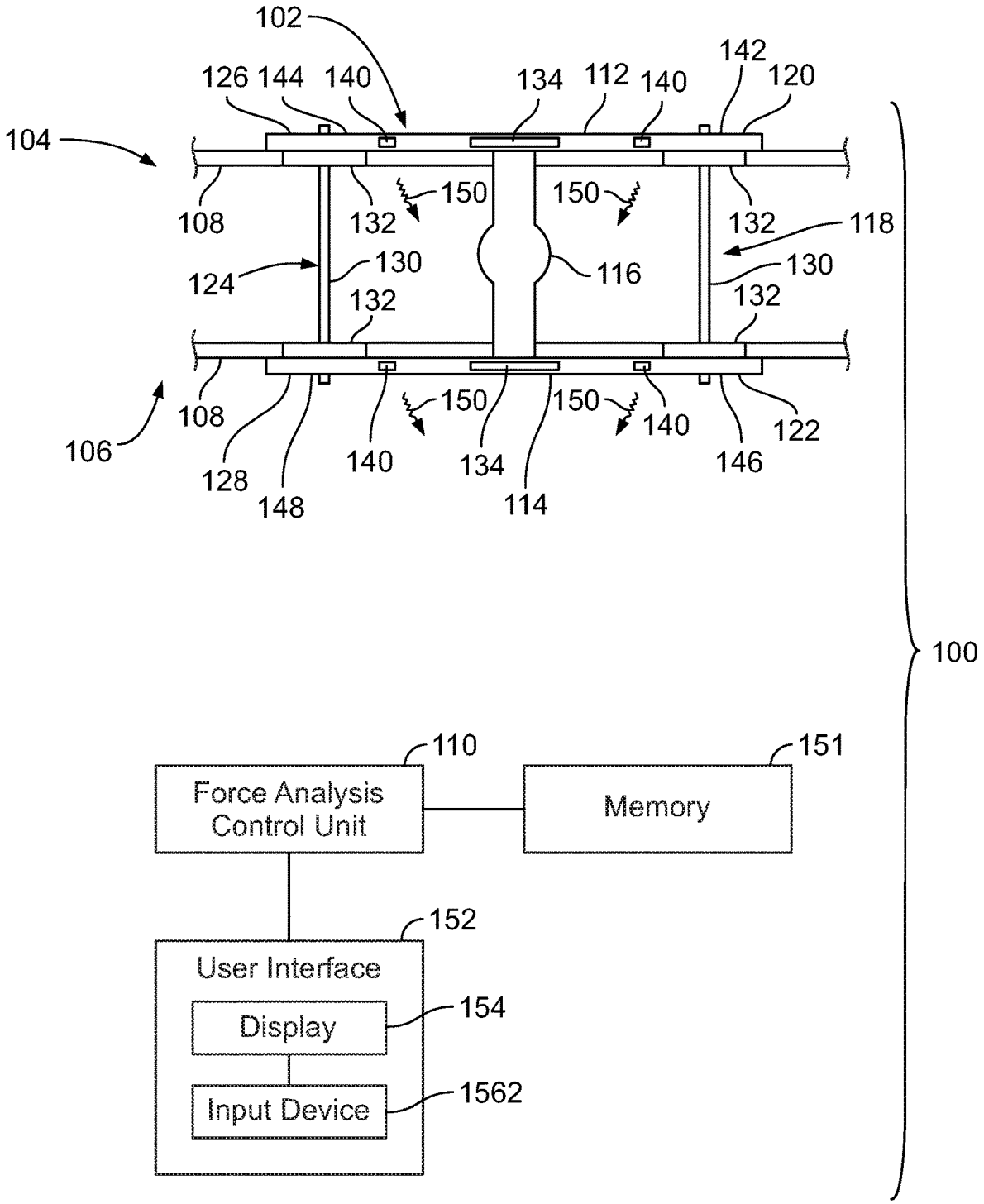
FIG. 1 illustrates a simplified schematic diagram of a force analysis system, according to an embodiment of the present disclosure.

FIG. 1 illustrates a simplified schematic diagram of a force analysis system 100, according to an embodiment of the present disclosure. The force analysis system 100 includes a truck assembly 102 that is configured to be supported on and travel over a railway 104 having a track 106 that includes parallel rails 108. The force analysis system 100 also includes a force analysis control unit 110.

The truck assembly 102 includes a first side frame 112 and a second side frame 114 coupled together by a bolster 116. A first wheel set 118 is rotatably coupled to first ends 120 and 122 of the first side frame 112 and the second side frame 114, respectively, and a second wheel set 124 is rotatably coupled to second ends 126 and 128 of the first side frame 112 and the second side frame 114, respectively. Each of the first and second wheel sets 118 and 124 includes an axle 130 connected to wheels 132. The wheels 132 are supported on the rails 108 and are configured to travel thereon as the axles 130 rotate in relation to the first side frame 112 and the second side frame 114.

The first and second side frames 112 and 114 includes damper systems 134. For example, the damper systems 134 include one or more springs, friction shoes, and the like that are configured to dampen forces exerted into and/or by the truck assembly 102 as the truck assembly 102 travels along the track 106.

The truck assembly 102 also includes one or more load cells 140. In at least one embodiment, the load cells 140 are integrally formed with the side frames 112 and 114. The load cells 140 are integrated into the side frames 112 and 114, and therefore form an integral part of the truck assembly 102, in contrast to temporary sensors that may be removably mounted to outer surfaces of the truck assembly 102. The load cells 140 may be integrally fixed or otherwise secured within the side frames 112 and 114. That is, the load cells 140 are not temporary sensors, which may be temporarily mounted on outer surfaces of the truck assembly 102. Instead, the load cells 140 are embedded, mounted, secured, or otherwise disposed within the side frames 112 and 114. In at least one embodiment, the load cells 140 are operatively coupled to the damper systems 134.

As shown, load cells 140 are disposed within the first side frame 112 at or proximate to a first end 142 and a second end 144. Similarly, load cells 140 are disposed within the second side frame 114 at or proximate to a first end 146 and a second end 148. Optionally, the truck assembly 102 may include more or less load cells 140 than shown. For example, the truck assembly 102 may include only a load cell 140 at or proximate one of the first end 142 or the second end 144 of the first side frame 112, and a load cell 140 at or proximate one of the first end 146 or the second end 148 of the second side frame 114. In at least one other embodiment, the truck assembly 102 may include only a single load cell 140, such as at or proximate to one of the first end 142, the second end 144, the first end 146, or the second end 148. In at least one other embodiment, one or more of the load cells 140 may be located at areas of the side frames 112 and 114 other than at or proximate the first end 142, the second end 144, the first end 146, and the second end 148. For example, one or more load cells 140 may be on or within the damper systems 134.

In at least one embodiment, the load cells 140 include transducers that are configured to convert forces into measurable electrical outputs. Each load cell 140 may be or include a transducer that creates an electrical signal having a magnitude that is directly proportional to a force being measured. The load cells 140 may include strain gages, for example. The load cells 140 may be strain gage load cells, hydraulic load cells, or pneumatic load cells. In at least one embodiment, the load cells 140 are configured to detect forces and/or components thereof in relation to three mutually orthogonal axes, such as an X axis, a Y axis, and a Z axis.

In operation, as the truck assembly 102 travels along the track 106, the load cells 140 detect (for example, measure) forces that are exerted in relation to the truck assembly 102 (such as forces exerted into the truck assembly 102 and/or forces exerted by the truck assembly 102). In at least one embodiment, the load cells 140 detect forces that are exerted into the side frames 112 and 114. In at least one embodiment, the load cells 140 are coupled to the damper systems 134. As such, the load cells 140 are configured to detect frictional forces (for example, frictional forces exerted by, into, and/or onto) the damper systems 134, such as during operation thereof.

The load cells 140 detect the forces, which the load cells 140 output as force signals 150. The force analysis control unit 110 is in communication with the load cells 140 through one or more wireless or wired connections. As such, the force analysis control unit 110 receives the force signals 150 including force data detected by the load cells 140.

In at least one embodiment, the force analysis control unit 110 may be onboard a rail car that includes the truck assembly 102. In at least one embodiment, the force analysis control unit 110 is secured on or within the truck assembly 102. In at least one other embodiment, the force analysis control unit 110 is remotely located from the truck assembly 102 and/or a rail car including the truck assembly 102. For example, the force analysis control unit 110 may be at a central monitoring station that is remotely located from the truck assembly 102. In at least one embodiment, the force analysis control unit 110 is in continuous communication with the load cells 140. In at least one other embodiment, the force analysis control unit 110 is in periodic communication with the load cells 140. For example, the load cells 140 may detect forces, and store force data within a memory coupled to the load cells 140, such as on or within the truck assembly 102 and/or a rail car that includes the truck assembly 102. The force analysis control unit 110 may receive the force signals 150 including the force data, such as by removably connecting to the memory via an adapter or a connector, such as a United Serial Bus (USB) connector.

The force analysis control unit 110 receives the force signals 150, which include the force data as detected by the load cells 140, and stores the force data in a memory 151, which may be part of the force analysis control unit 110, or in communication with the force analysis control unit 110 through one or more wired or wireless connections. The force analysis control unit 110 displays the force data to an individual at a user interface 152, which is communicatively coupled to the force analysis control unit 110 through one or more wired or wireless connections. The user interface 152 may include a display 154 and an input device 156, which are in communication with the force analysis control unit 110, such as through one or more wired or wireless connections. The display 154 may be a monitor, screen, or the like, such as of a computer workstation, a smart device (such as a smart phone or tablet), or the like. The input device 156 may be a keyboard, mouse, stylus, or the like. In at least one embodiment, the display 154 and the input device 156 provide a touchscreen interface.

The force analysis control unit 110 outputs the force data (as included in the force signals 15) to the user interface 152. The user interface 152 then outputs the force data to an individual, such as by displaying the force data on the display 154.

The force data may be analyzed to determine a structural status of the truck assembly 102. For example, the force data shown on the display 154 by the force analysis control unit 110 may be analyzed to determine the structural integrity of the side frames 112 and 114, the effectiveness of the damper systems 134, and/or the like. The force analysis control unit 110 may receive the force signals 150 including the force data from the load cells 140 over the life of the truck assembly 102 so that a determination may be made in relation to maintenance and/or replacement of the truck assembly 102. Further, the force data may be analyzed to determine the magnitude of the forces exerted into the truck assembly 102, including the side frames 112 and 114 and/or the damper systems 134, in order to assess and design possibilities for future truck assemblies. For example, by analyzing the detected forces, individuals may determine that different materials, shapes, sizes, configurations, and/or the like may be used for future truck assemblies.

As used herein, the term "control unit," "central processing unit," "unit," "CPU," "computer," or the like may include any processor-based or microprocessor-based system including systems using microcontrollers, reduced instruction set computers (RISC), application specific integrated circuits (ASICs), logic circuits, and any other circuit or processor including hardware, software, or a combination thereof capable of executing the functions described herein. Such are exemplary only, and are thus not intended to limit in any way the definition and/or meaning of such terms. For example, the force analysis control unit 110 (and/or portions thereof) may be or include one or more processors that are configured to control operation thereof, as described herein.

The force analysis control unit 110 is configured to execute a set of instructions that are stored in one or more data storage units or elements (such as one or more memories), in order to process data. For example, the force analysis control unit 110 may include or be coupled to one or more memories. The data storage units may also store data or other information as desired or needed. The data storage units may be in the form of an information source or a physical memory element within a processing machine.

The set of instructions may include various commands that instruct the force analysis control unit 110 as a processing machine to perform specific operations such as the methods and processes of the various embodiments of the subject matter described herein. The set of instructions may be in the form of a software program. The software may be in various forms such as system software or application software. Further, the software may be in the form of a collection of separate programs, a program subset within a larger program or a portion of a program. The software may also include modular programming in the form of object-oriented programming. The processing of input data by the processing machine may be in response to user commands, or in response to results of previous processing, or in response to a request made by another processing machine.

The diagrams of embodiments herein may illustrate one or more control or processing units, such as the force analysis control unit 110. It is to be understood that the processing or control units may represent circuits, circuitry, or portions thereof that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the force analysis control unit 110 may represent processing circuitry such as one or more of a field programmable gate array (FPGA), application specific integrated circuit (ASIC), microprocessor(s), and/or the like. The circuits in various embodiments may be configured to execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in a data storage unit (for example, one or more memories) for execution by a computer, including RAM memory, ROM memory, EPROM memory, EEPROM memory, and non-volatile RAM (NVRAM) memory. The above data storage unit types are exemplary only, and are thus not limiting as to the types of memory usable for storage of a computer program.

Figure 2:
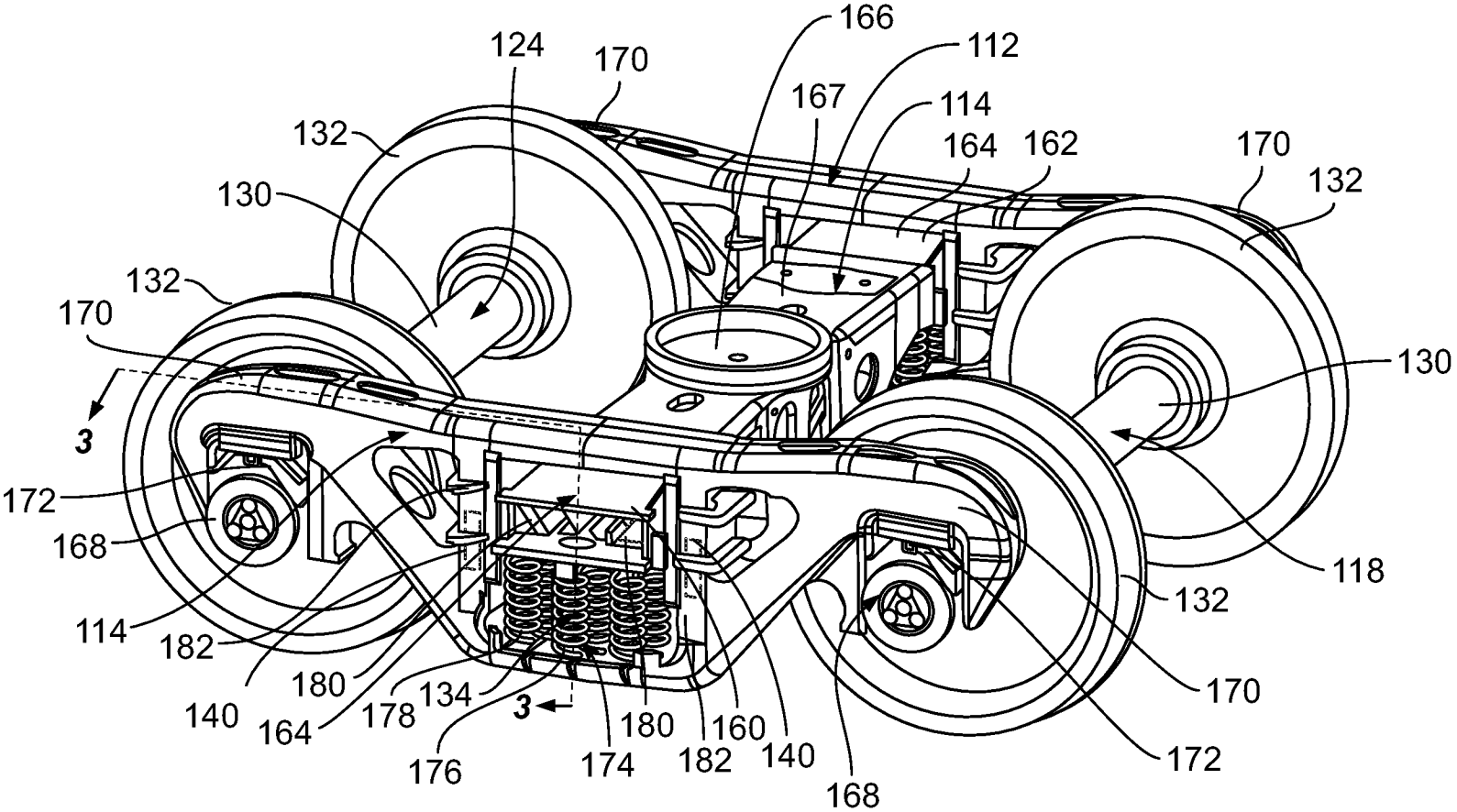
FIG. 2 illustrate a perspective top view of a truck assembly, according to an embodiment of the present disclosure.

FIG. 2 illustrate a perspective top view of the truck assembly 102, according to an embodiment of the present disclosure. The truck assembly 102 includes the first side frame 112 and the second side frame 114, which are spaced apart from one another. The bolster 116 extends between the first side frame 112 and the second side frame 114, and couples the first side frame 112 to the second side frame 114.

The bolster 116 includes ends 160 and 162, which extend through openings 164 of the side frames 112 and 114. The bolster 116 also includes a bolster center plate 166 outwardly extending from an upper surface 167.

The wheel sets 118 and 124 include the axles 130 and the wheels 132. Ends of the axles 130 are rotatably retained by bearings 168, which are coupled to the side frames 112 and 114. In particular, the wheel sets 118 and 124 are coupled to the side frames 112 and 114 at pedestals 170 of the side frames 112 and 114. The pedestals 170 connect to bearing adapters 172 that connect to the bearings 168.

The damping systems 134 include a spring group 174 supported within the openings 164 of the side frames 112 and 114. The spring groups 174 include load coils 176 and control coils 178. The load coils 176 support the bolster 116 at the ends 160 and 162. The control coils 178 support friction shoes 180.

The load cells 140 are disposed within the side frames 112 and 114, proximate to the friction shoes 180. For example, the load cells 140 may be embedded, mounted, or otherwise disposed within columns 182 of the side frames 112 and 114 that abut against the friction shoes 180.

Figure 3:
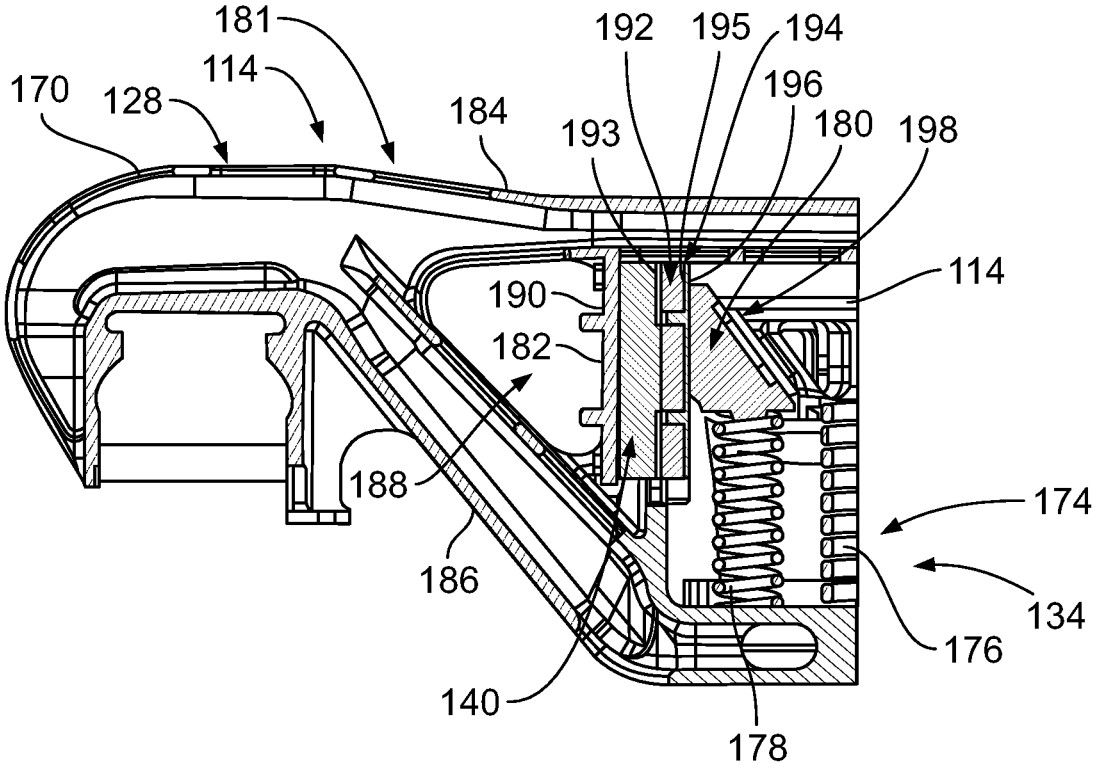
FIG. 3 illustrates a cross-sectional view of a side frame through line 3-3 of FIG. 2, according to an embodiment of the present disclosure.

FIG. 3 illustrates a cross-sectional view of the side frame 114 through line 3-3 of FIG. 2, according to an embodiment of the present disclosure. FIG. 3 illustrates the side frame 114, but is representative of each of the first ends 120, 122 and second ends 126 and 128 of the side frames 112 and 114, as shown in FIGS. 1 and 2.

The side frame 114 (and the side frame 112) includes a frame body 181 that includes the column 182 that couples to a compression member 184 (such as one or more beams) that connects to the pedestal 170. An angled tension member 186 (such as one or more beams) extends from a lower end of the column 182 to the pedestal 170, such that a window 188 is defined between the column 182, the compression member 184, and the tension member 186. As shown, the column 182 may be generally vertical, and perpendicular to the compression member 184.

The load cell 140 is secured within the column 182. In at least one embodiment, the load cell 140 is disposed and secured within a recess pocket formed in the column 182. In at least one embodiment, the load cell 140 is embedded within the column 182. As such, the load cell 140 may be internally disposed within the column 182, instead of being temporarily mounted on an outer surface of the column 182. By disposing the load cell 140 within the column 182, the outer shape and profile of the side frame 114 may be the same as a standard side frame, thereby allowing the side frame 114 to be used in place of any traditional side frame. Accordingly, incorporating the load cells 140 into the side frames 112 and 114, such that the size and shape of the truck assembly 100 is the same, as or similar to, a traditional truck assembly, the embodiments of the present disclosure provide truck assemblies that meet all requirements and specifications of the Association of American Railroads for free interchange service.

The load cell 140 is sandwiched between an outer end wall 190 of the column 182 and the friction shoe 180. In at least one embodiment, a bolt plate 192 is coupled to an interior surface 193 of the load cell 140. Further, a column wear plate 194 may be coupled to an interior surface 195 of the bolt plate 192. An interior surface 196 of the column wear plate 194 abuts against the friction shoe 180. Optionally, the load cell 140 may abut directly into the friction shoe 180 without the intervening column wear plate 194 and the bolt plate 192. As another option, the load cell 140 may abut against the bolt plate 192, which abuts against friction shoe 180.

Frictional forces exerted in relation to (such as on, into, and/or by) the friction shoe 180 are translated to the load cell 140. In this manner, the load cell 140 is able to detect forces exerted in relation to the friction shoe 180. Referring to FIGS. 1-3, the load cell 140 detects the frictional forces exerted in relation to the friction shoe 180 and outputs the force signals 150 including the force data indicative of the frictional forces exerted in relation to the friction shoe 180.

The load coils 176 support the bolster 116 and the control coils 178 support the friction shoe 180. As the spring group 174 is loaded by a railcar supported by the truck assembly 102 via the bolster 116, the spring group 174 compresses. Further, the spring group 174 also compresses and decompresses as the truck assembly 102 rolls over undulating track, which causes the truck assembly 102 (or at least portions thereof) to vertically and laterally move. Such movement is translated between the bolster 116 and the side frames 112 and 114. The movement is damped between the friction shoes 180 and the column wear plate 194. The control coils 178 force the friction shoes 180 against wedge surfaces 198 (such as plates) between the bolster 116 and the friction shoe 180. In at least one embodiment, the friction shoes 180 include the wedge surfaces 198. The wedge surfaces 198 transfer the vertical forces of the control coil 178 to wedge forces that are translated through the friction shoe 180 into the column wear plates 194. The forces between the surfaces of the friction shoes 180 and the column wear plates 194 create resistance to movement. Surfaces of the friction shoes 180 and the wear plates 194 also contribute to the resistance to movement. Such frictional forces are detected by the load cells 140 within the columns 182, and which are in load paths that include the control coils 178 and the friction shoes 180.

Figure 4:
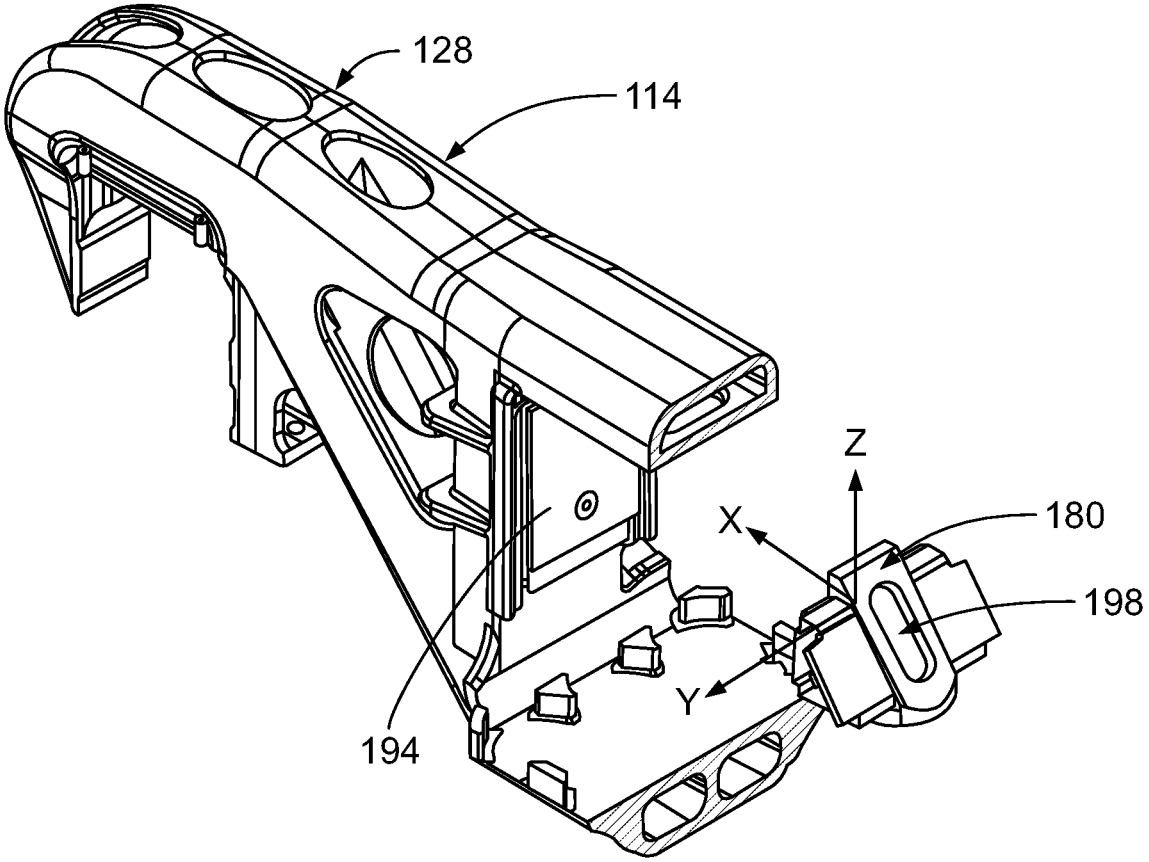
FIG. 4 illustrates a perspective top view of an end of a side frame, according to an embodiment of the present disclosure.

FIG. 4 illustrates a perspective top view of the end 128 of the side frame 114, according to an embodiment of the present disclosure. While the end 128 of the side frame 114 is shown in FIG. 4, the other ends 120, 122, and 126 (shown in FIGS. 1 and 2) are configured in a similar manner. As such, the discussion regarding the end 128 is equally applicable to the ends 120, 122, and 126.

For the sake of clarity, the friction shoe 180 is shown projected away from the column wear plate 194. The friction shoe 180 is able to exert forces into the column wear plate 194 in directions along the X axis, the Y axis, and the Z axis, which are mutually orthogonal axes. The force exerted by the wedge surface 198 is along the X direction. Forces exerted along a plane defined by the Y axis and the Z axis are in relation to resistance to movement between the face or interior surface 196 of the column wear plate 194 to the opposing face of the friction shoe 180. Forces exerted along a plane defined by the Y axis and the Z axis relate to a coefficient of friction.

Figure 5:
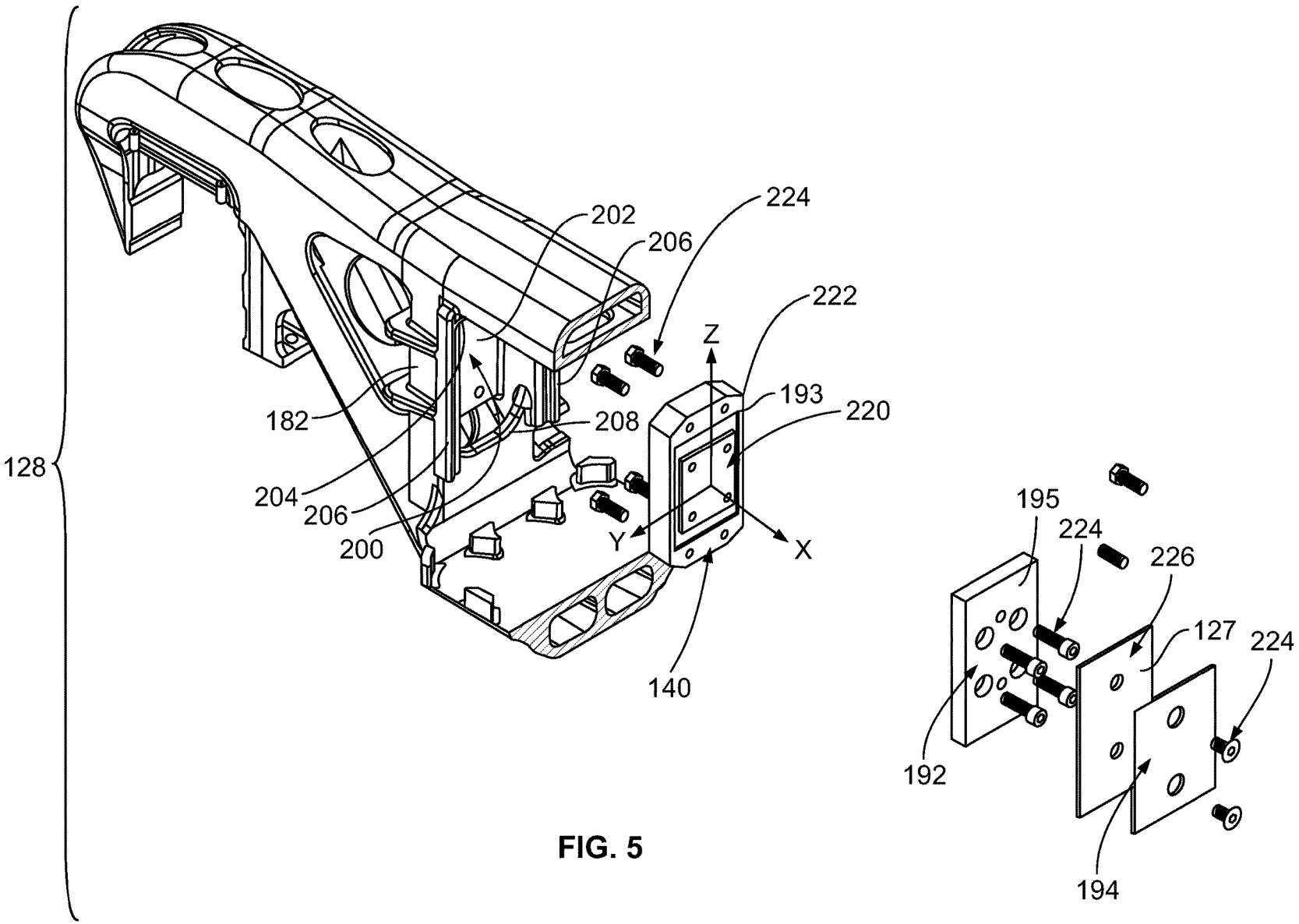
FIG. 5 illustrates a perspective top, exploded view of the end of the side frame shown in FIG. 4.

FIG. 5 illustrates a perspective top, exploded view of the end 128 of the side frame 114 shown in FIG. 4. In at least one embodiment, the column 182 includes a recess pocket 200 defined between an internal wall 202, an upper ledge 204, opposed lateral walls 206, and a lower edge 208. The recess pocket 200 is formed within the column 182, and is sized and shaped to conform to outer surfaces of the load cell 140. As such, the load cell 140 is received and retained within the recess pocket 200.

A load plate 220 may be mounted to the interior surface 193 of the load cell 140. The interior surface 193 may include a mounting plate 222 to which the load plate 220 is secured. Fasteners 224, such as cap screws, may be used to securely couple the load cell 140, including the load plate 220 and the mounting plate 222, to the bolt plate 192. An insulator plate 226 may be secured to the interior surface 195 of the bolt plate 192. The column wear plate 194 may be secured to an interior surface 227 of the insulator plate 226 through fasteners 224. Optionally, more or less plates than shown may be used. For example, the column wear plate 194 may directly couple to the load cell 140 without the intervening plates shown in FIG. 5. Further, optionally, the load cell 140 may be secured within the recess pocket 200 without the use of separate and distinct fasteners. As an example, the load cell 140 may be securely retained within the recess pocket 200 through an interference fit, adhesives, and/or the like.

In at least one embodiment, forces are measured between the mounting plate 222 and the load plate 220. The load cell 140 is located in the X, Y, and Z coordinate system and measures the coordinate forces therein.

Referring to FIGS. 1-5, in at least one embodiment, the load cells 140 are 3 axis load cells that are configured to detect forces (or components thereof) exerted in relation to the X axis, the Y axis, and the Z axis. The load cells 140 are integrated into the side frames 112 and 114 of the truck assembly 102 and are configured to detect (for example, measure) normal forces generated by the friction shoes 180 abutting against the column wear plate 194. In at least one embodiment, the load cells 140 detect a resultant resistance to vertical and lateral movement. In at least one embodiment, the load cells 140 detect a resultant resistance of movement of a dynamic mass of the truck assembly 102 sliding over the column wear plates 194 and mating surfaces of the friction shoes 180. In at least one embodiment, the load cells 140 detect resistance to movement of the column wear plates 194 to mating surfaces of the friction shoes 180 with respect to material hardness, roughness, and surface-to-surface velocity.

In at least one embodiment, the truck assembly 102 includes the load cells 140 within the side frames 112 and 114 that are configured to detect forces exerted in relation to the friction shoes 180. The load cells 140 detect force data, and output force signals 150 that include the force data. The force signals 150 are received and collected by the force analysis control unit 110. The force data may be used to develop friction damping for performance test requirements, and also with respect to revenue service for long term endurance analysis of truck assemblies and components thereof.

Figure 6:
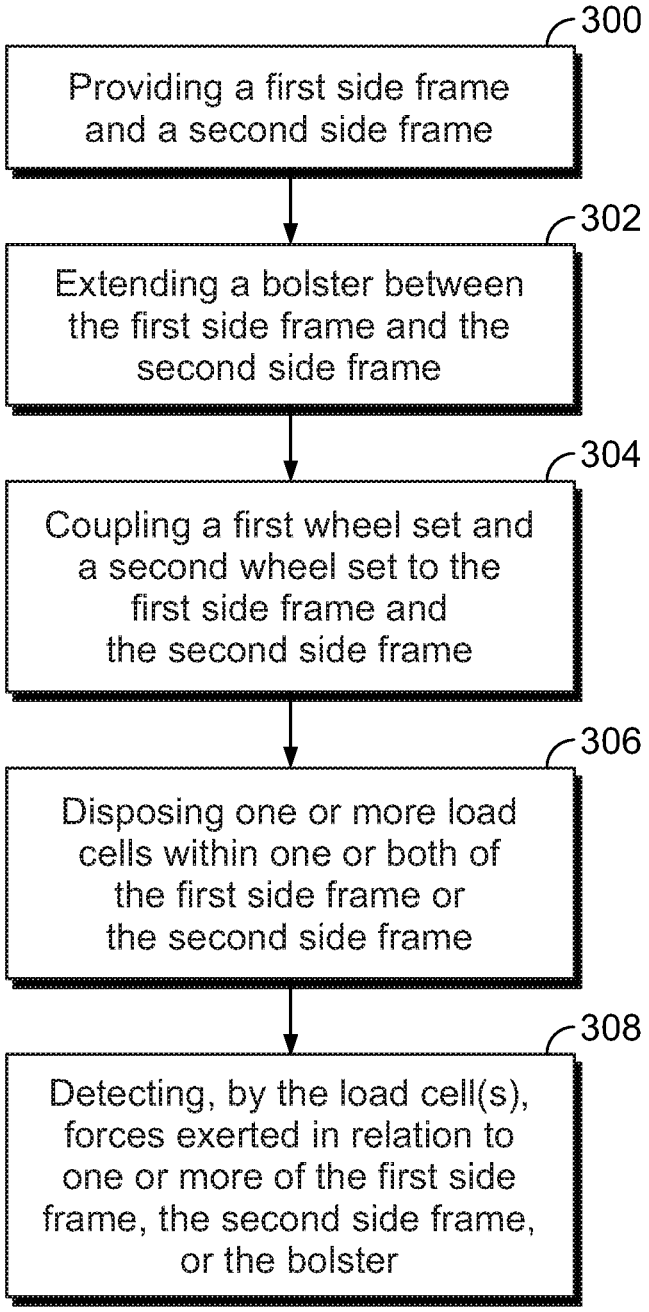
FIG. 6 illustrates a flow chart of a force analysis method, according to an embodiment of the present disclosure.

FIG. 6 illustrates a force analysis method, according to an embodiment of the present disclosure. Referring to FIGS. 1-6, the force analysis method is for the truck assembly 102, which is configured to travel along the track 106 having rails 108. The force analysis method includes providing 300 the first side frame 112 and the second side frame 114, extending 302 a bolster 116 between the first side frame 112 and the second side frame 114, coupling 304 the first wheel set 118 and the second wheel set 124 to the first side frame 112 and the second side frame 114, disposing 306 one or more load cells 140 within one or both of the first side frame 112 or the second side frame 114, and detecting 308, by the one or more load cells 140, forces exerted in relation to one or more of the first side frame 112, the second side frame 114, or the bolster 116.

In at least one embodiment, the detecting includes detecting the forces exerted in relation to friction shoes 180. The force analysis method may include connecting the load cell(s) 140 to the friction shoe(s) 180.

In at least one embodiment, the detecting includes detecting frictional forces exerted in relation to the friction shoe(s) 180, and outputting the force signals 150 including force data indicative of the frictional forces exerted in relation to the friction shoe(s) 180.

The force analysis method may also include coupling a first damper system 134 to the first side frame 112, and coupling a second damper system 134 to the second side frame 114. In at least one embodiment, the coupling the first damper system 134 and the coupling the second damper system 134 include supporting the bolster 116 with the load coils 176, and supporting the friction shoes 180 with the control coils 178. The force analysis method may also include operatively coupling the load cell(s) 140 to one or both of the first damper system 134 and the second damper system 134.

In at least one embodiment, the disposing the load cell(s) 140 includes integrally forming one or both of the first side frame 112 or the second side frame 114 with the load cell(s) 140. In at least one embodiment, the disposing the load cell(s) 140 includes disposing the load cell(s) 140 within one or both of the first side frame 112 or the second side frame 114.

The force analysis method may include outputting, by the load cell(s) 140, the force signals 150 including force data indicative of the forces. The force analysis method may also include receiving, by the force analysis control unit 110, the force signals.

In at least one embodiment, the disposing the load cell(s) 140 includes disposing the load cell(s) 140 within one or more columns 182 of one or both of the first side frame 112 or the second side frame 114. The disposing the load cell(s) 140 may also include disposing the load cell(s) 140 within one or more recess pockets 200 formed in the column(s) 182.

In at least one embodiment, the disposing the load cell(s) 140 includes disposing the load cell(s) 140 between outer end walls of columns 182 of one or both of the first side frame 112 or the second side frame 114 and one or more friction shoes 180 coupled to one or both of the first side frame 112 or the second side frame 114. The force analysis method may further include coupling one or more bolt plates 192 to the load cell(s) 140, and coupling one or more column wear plates 194 to the bolt plate(s) 192.

As described herein, embodiments of the present disclosure provide systems and methods for analyzing forces exerted into a truck assembly of a rail vehicle. Further, embodiments of the present disclosure provide systems and methods for monitoring forces exerted into a truck assembly during operation thereof. Moreover, embodiments of the present disclosure provide systems and methods for gathering force data exerted into a truck assembly in order to determine a structural integrity of the truck assembly, as well as design considerations for future truck assemblies.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. A truck assembly that is configured to travel along a track having rails, the truck assembly comprising:
- a first side frame;
- a second side frame;
- a bolster extending between the first side frame and the second side frame;
- a first wheel set coupled to the first side frame and the second side frame;
- a second wheel set coupled to the first side frame and the second side frame; and
- one or more load cells contained within one or more columns of one or both of the first side frame or the second side frame, wherein the one or more load cells are configured to detect forces exerted in relation to one or more of the first side frame, the second side frame, or the bolster.

2. The truck assembly of claim 1, further comprising one or more friction shoes, wherein the one or more load cells are configured to detect the forces exerted in relation to the one or more friction shoes.

3. The truck assembly of claim 2, wherein the one or more load cells connect to the one or more friction shoes.

4. The truck assembly of claim 2, wherein the one or more load cells detect frictional forces exerted in relation to the one or more friction shoes, and output force signals including force data indicative of the frictional forces exerted in relation to the one or more friction shoes.

5. The truck assembly of claim 1, further comprising:
- a first damper system coupled to the first side frame; and
- a second damper system coupled to the second side frame.

6. The truck assembly of claim 5, wherein each of the first damper system and the second damper system comprises:
- load coils that support the bolster; and
- control coils that support friction shoes.

7. The truck assembly of claim 5, wherein the one or more load cells are operatively coupled to one or both of the first damper system or the second damper system.

8. The truck assembly of claim 1, wherein the one or more load cells are integrally formed with one or both of the first side frame or the second side frame.

9. The truck assembly of claim 1, wherein the one or more load cells comprise a first load cell contained within a first column of the first side frame, and a second load cell contained within a second column of the second side frame.

10. The truck assembly of claim 1, wherein the one or more load cells are configured to output force signals including force data indicative of the forces.

11. The truck assembly of claim 10, wherein the force signals are received by a force analysis control unit.

12. The truck assembly of claim 1, wherein the one or more columns comprises one or more recess pockets, and wherein the one or more load cells are disposed within the one or more recess pockets.

13. The truck assembly of claim 1, wherein the one or more load cells are disposed between outer end walls of the one or more columns of one or both of the first side frame or the second side frame and one or more friction shoes coupled to one or both of the first side frame or the second side frame.

14. The truck assembly of claim 13, further comprising:
- one or more bolt plates coupled to the one or more load cells; and
- one or more column wear plates coupled to the one or more bolt plates.

15. The truck assembly of claim 1, wherein the one or more load cells are sandwiched between an outer end wall of the one or more columns and a friction shoe, wherein a bolt plate is coupled to an interior surface of the one or more load cells, wherein a column wear plate is coupled to an interior surface of the bolt plate, and wherein an interior surface of the column wear plate abuts against the friction shoe.

16. The truck assembly of claim 15, wherein forces between the friction shoe and the column wear plate create resistance to movement, wherein portions of the friction shoe and the column wear plate also contribute to the resistance to movement, and wherein frictional forces related to the resistance to movement are detected by the one or more load cells.

17. The truck assembly of claim 1, wherein the one or more load cells are 3 axis load cells.

18. A force analysis system comprising:

a truck assembly that is configured to travel along a track having rails, the truck assembly comprising:

a first side frame;

a second side frame;

a bolster extending between the first side frame and the second side frame;

a first wheel set coupled to the first side frame and the second side frame;

a second wheel set coupled to the first side frame and the second side frame; and one or more load cells contained within one or more columns within one or both of the first side frame or the second side frame, wherein the one or more load cells are configured to detect forces exerted in relation to one or more of the first side frame, the second side frame, or the bolster, wherein the one or more load cells are configured to detect forces exerted in relation to the truck assembly and output force signals including force data indicative of the forces;

a force analysis control unit in communication with the one or more load cells, wherein the force analysis control unit is configured to receive the force signals; and a user interface in communication with the force analysis control unit, wherein the force analysis control unit is configured to output the force data to the user interface.

19. A force analysis method for a truck assembly that is configured to travel along a track having rails, the force analysis method comprising:

providing a first side frame;

providing a second side frame;

extending a bolster between the first side frame and the second side frame;

coupling a first wheel set and a second wheel set to the first side frame and the second side frame;

containing one or more load cells within one or more columns of one or both of the first side frame or the second side frame; and detecting, by the one or more load cells, forces exerted in relation to one or more of the first side frame, the second side frame, or the bolster.

20. A side frame for a truck assembly that is configured to travel along a track having rails, the side frame comprising:

a frame body including a column; and a load cell contained within the column of the frame body, wherein the load cell is configured to detect forces exerted in relation to the side frame.

21. The truck assembly of claim 1, wherein the one or more load cells are not mounted to any outer surface of the first side frame or the second side frame.

* * * * *